US008136203B2

(12) United States Patent
Klassen et al.

(10) Patent No.: US 8,136,203 B2
(45) Date of Patent: Mar. 20, 2012

(54) HINGE ARRANGEMENT

(75) Inventors: Samuel Klassen, Haiger (DE); Reimar Claes, Haiger (DE)

(73) Assignee: Rittal RCS Communication Systems GmbH & Co. KG, Haiger (DE)

( * ) Notice: Subject to any disclaimer, the term of this patent is extended or adjusted under 35 U.S.C. 154(b) by 0 days.

(21) Appl. No.: 12/450,822

(22) PCT Filed: Apr. 9, 2008

(86) PCT No.: PCT/EP2008/002784

§ 371 (c)(1),
(2), (4) Date: Mar. 18, 2010

(87) PCT Pub. No.: WO2008/125252

PCT Pub. Date: Oct. 23, 2008

(65) Prior Publication Data

US 2010/0175221 A1 Jul. 15, 2010

(30) Foreign Application Priority Data

Apr. 13, 2007 (DE) ..... 10 2007 017 916

(51) Int. Cl.
*E05D 15/50* (2006.01)

(52) U.S. Cl. ..... 16/231; 16/230

(58) Field of Classification Search ..... 16/230–232, 16/DIG. 23, 386, 387, 258, 261, 262; 49/193, 49/192, 381, 395; 312/324, 325, 326, 328
See application file for complete search history.

(56) References Cited

U.S. PATENT DOCUMENTS

| | | | | | |
|---|---|---|---|---|---|
| 2,160,330 | A * | 5/1939 | Hass et al. | ..... | 16/230 |
| 2,195,991 | A * | 4/1940 | Lovett | ..... | 16/230 |
| 2,650,388 | A * | 9/1953 | White | ..... | 16/230 |
| 2,660,752 | A * | 12/1953 | Carcereny | ..... | 16/230 |
| 3,030,656 | A * | 4/1962 | Hopkins | ..... | 16/230 |
| 5,357,652 | A * | 10/1994 | Yamada | ..... | 16/232 |
| 5,490,305 | A * | 2/1996 | Domingo Ribot | ..... | 16/229 |
| 5,983,453 | A * | 11/1999 | Miwa | ..... | 16/231 |
| 7,458,132 | B2 * | 12/2008 | Kwon | ..... | 16/230 |
| 2001/0011405 | A1 * | 8/2001 | Minami | ..... | 16/229 |

FOREIGN PATENT DOCUMENTS

| | | | |
|---|---|---|---|
| DE | 10 2007 012 980 | A1 | 9/2008 |
| GB | 726711 | | 3/1955 |
| GB | 2 266 919 | A | 11/1993 |

* cited by examiner

*Primary Examiner* — Chuck Y. Mah
(74) *Attorney, Agent, or Firm* — Pauley Petersen & Erickson

(57) ABSTRACT

A hinge arrangement of a door for closing off an opening, such as a housing opening, a partition opening, a wall opening, or the like, having at least one pivot pin connected to the door and oriented vertically in the direction of the housing, wherein the pin can be engaged in a pivot pin receptacle on the housing. The pivot pin can be moved from a retracted position, in which the pivot pin is not engaged in the pivot pin receptacle, by vertical displacement into an extended position in which the pivot pin is engaged in the pivot pin receptacle and is rotatably supported therein. A releasable, spring-loaded locking device acts on the pivot pin and holds the pivot pin in the retracted position.

12 Claims, 9 Drawing Sheets

HINGE ARRANGEMENT

BACKGROUND OF THE INVENTION

1. Field of the Invention

This invention relates to a hinge arrangement of a door for shooting an opening such as a housing opening, partition opening, wall opening, or the like, having at least one pivot pin that is connected to the door, that points vertically toward the housing, and can be brought into engagement in a pivot pin receptacle in the housing. By sliding vertically, the pivot pin can be moved from a retracted position in which the pivot pin is not engaged in the pivot pin receptacle into an extended position in which the pivot pin is engaged and rotatably supported in the pivot pin receptacle.

2. Discussion of Related Art

German Patent Reference DE 10 2007 012 980.9 discloses a door arrangement in which the attachment side, such as the hinge side, can be switched in order to permit the door to open toward a different side. To permit the door to first be attached at will, first at the left and then at the right, the door is embodied with two attachment sides. In this case, each attachment side has a hinge, which through corresponding actuation of an actuating lever, can be brought into one position to form a hinge and into another position to form a latch.

When functioning as a hinge, a pair of one pivot pin pointing vertically upward and one pivot pin pointing vertically downward engages in corresponding pivot pin receptacles in the housing. If the hinge or latch on an attachment side is to be opened, then through corresponding actuation of the actuating lever, the two pivot pins on the corresponding attachment side are retracted from the associated pivot pin receptacles so that the door can be opened on the attachment side. The hinge on the other attachment side remains closed in this case.

If the door is open on one side and the actuating lever is actuated again in order to open the other attachment as well, this can lead to an unintended unhinging of the door, which can result in damage to the door if it is not held firmly.

On the other hand, problems can arise when closing the door if unintentional actuation of the actuating lever causes the pivot pins to be brought into an extended position in which they protrude from the door.

SUMMARY OF THE INVENTION

One object of this invention is to provide a hinge arrangement that assures a reliable function of the door provided with two attachment sides, even in the event of inadvertent actuation of the actuating lever and also prevents an unintended unhinging of the door.

This object of this invention is attained by a hinge arrangement having characteristics defined in this specification and in the claims, including advantageous modifications of the door arrangement according to this invention.

According to this invention, an unlockable spring-loaded locking device acts on the pivot pin, holding the pivot pin in the retracted position. As long as the pivot pin is secured in the retracted position, the actuating lever on the door cannot be brought into a position in which both attachment sides of the door are opened and the door can be unhinged. Thus, the door can only be unhinged when the locking device is released.

Only when the locking device is released can the pivot pin move through a pivot pin passage on the door edge oriented toward the housing, moving in the direction toward the pivot pin receptacle aligned with the pivot pin passage.

According to one preferred embodiment of this invention, a securing spring can exert its action between the door and the pivot pin, acting laterally on the pivot pin, sliding it laterally into the locked position of the locking device so that the vertical sliding direction of the pivot pin is oriented toward a region of the door adjacent to the pivot pin passage so that the pivot pin cannot travel through the pivot pin passage. This measure makes it possible to effectively avoid an unintended actuation when the door is open.

The securing spring can be advantageously actuated in opposition to its prestressing direction, thus bringing the locking device into its unlocked position. The prestressing force of the spring keeps the locking device in its locked position.

According to a particularly simply designed embodiment, the securing spring can be a metal spring element of a piece of sheet metal.

In this case, the securing spring can have a through bore on the door interior, through which the pivot pin extends. This arrangement can be implemented simply and can assure a reliable function.

In order to assure that when the door is closed, the locking device is unlocked and permits a movement of the pivot pin, the securing spring can protrude from the door in the direction toward the housing wall. When the door is closed, the securing spring is then actuated by the housing wall, thus bringing the locking device into its unlocked position.

According to an alternative embodiment, the securing spring can be mounted to the outside of the door oriented toward the housing wall and can extend through an associated opening into the door interior. The securing spring then acts on the pivot pin inside the door.

In order to enable an intentional unhinging of the door after it is open, once the door is opened, the securing spring can be manually actuated directly so that the locking device is brought into its unlocked position.

A particularly effective and reliable locking device can be achieved if the securing spring is mounted to the door interior, on the side oriented toward the housing wall and is thus covered. On the housing wall, a pin is provided, which, when the door is closed, extends through an associated opening into the door interior and acts on the securing spring, thus bringing the locking device into its unlocked position.

However, the covered placement when the door is opened can also be actuated in an entirely intentional fashion by inserting an actuating pin into the opening to manually actuate the securing spring, thus bringing the locking device into its unlocked position.

According to a particularly functionally reliable embodiment, the pivot pin can be supported in a pin guide that is engaged by the securing spring. This assures that the pivot pin is particularly easy to slide.

According to another embodiment that features a particularly simple design, the door can be acted on by a securing spring that covers the pivot pin passage in the locked position of the locking device so that the pivot pin cannot be inserted through the pivot pin passage. In this case, the securing spring can have a guide plate that can be moved perpendicular to the pivot pin passage through actuation of the securing spring. The guide plate can have a through bore that is aligned with the pivot pin passage when the locking device is unlocked, thus permitting an insertion of the pivot pin into the pivot pin receptacle in the housing.

BRIEF DESCRIPTION OF THE DRAWINGS

This invention is explained in view of exemplary embodiments and with reference to the accompanying drawings, wherein.

DETAILED DESCRIPTION OF THE INVENTION

Figures 1A, 1B, 1C:
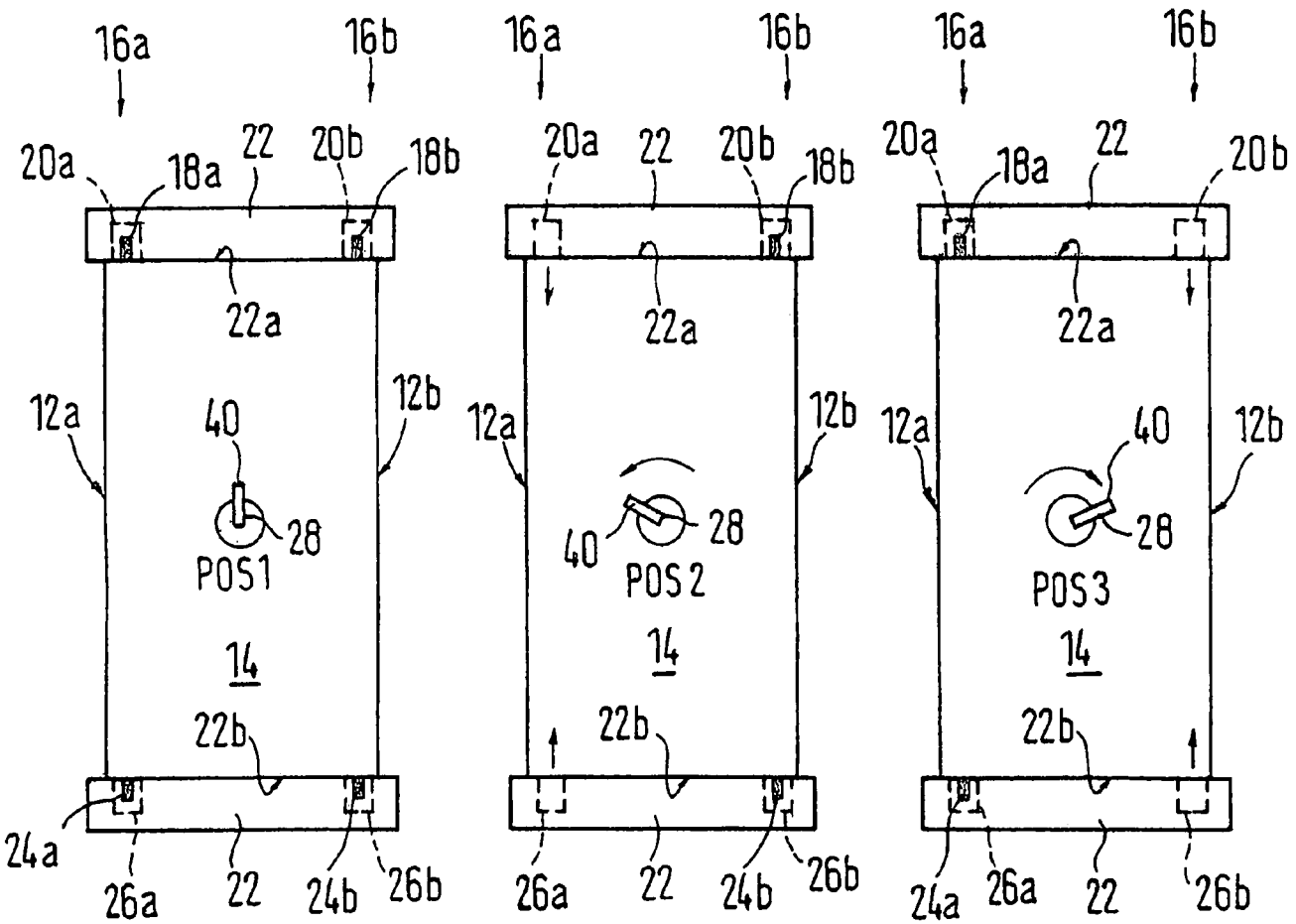
FIG. 1*a* is a schematic partial view of a door arrangement with two attachment sides in the "closed" actuation position.
FIG. 1*b* is a schematic partial view of the door arrangement shown in FIG. 1*a*, in the actuation position for "opening the left attachment side"
FIG. 1*c* is a schematic partial view of the door arrangement shown in FIGS. 1*a* and 1*b*, in the actuation position for "opening the right attachment side"

FIG. 1*a* is a schematic partial view of a door arrangement for closing a housing opening. A door panel 14 made of sheet steel has a left hinge 16*a* on its left attachment side 12*a*.

The left hinge 16*a* has an upper left pivot pin 18*a* that is connected to the door panel 14 and points vertically upward, and the upper left pivot pin 18*a* is engaged in an upper left pivot pin receptacle 20*a* in the housing 22 and rotatably supported therein.

The left hinge also has a lower left pivot pin 24*a* that is connected to the door panel 14 and points vertically downward, and the lower left pivot pin 24*a* is engaged in a lower left pivot pin receptacle 26*a* in the housing 22 and rotatably supported therein.

The door panel 14 also has a right attachment side 12*b* on which a right hinge 16*b* is provided. The right hinge 16*b* has an upper right pivot pin 18*b* that is connected to the door panel 14 and points vertically upward. The upper right pivot pin 18*b* is engaged in an upper right pivot pin receptacle 20*b* in the housing 22 and rotatably supported therein. The right hinge 16*b* also has a lower right pivot pin 24*b* that is connected to the door panel 14 and points vertically downward. The lower right pivot pin 24*b* is engaged in a lower right pivot pin receptacle 26*b* in the housing 22 and rotatably supported therein.

Adjacent to the door panel 14, the housing 22 has housing parts 22*a* and 22*b* that extend perpendicular to the pivot pins 18*a*, 18*b*, 24*a*, 24*b* and contain pivot pin receptacles 20*a*, 20*b*, 26*a*, and 26*b* in the form of circular recesses. The housing parts 22*a* and 22*b* extending perpendicular to the pivot pins 18*a*, 18*b*, 24*a*, 24*b* are of sheet metal and have pivot pin receptacles 20*a*, 20*b*, 26*a*, and 26*b* in the form of bores.

In its middle, the door panel 14 has an actuating element 28 that has an actuating handle 40 and is coupled to the left pivot pins 18*a*, 24*a* and the right pivot pins 18*b*, 24*b* and in FIG. 1*a* is brought into the "closed" actuation position, such as position 1 (POS1).

In the "closed" actuation position 1 (POS1), the left pivot pins 18*a* and 24*a* engage with the two left pivot pin receptacles 20*a* and 26*a* and the right pivot pins 18*b* and 24*b* engage with the two right pivot pin receptacles 20*b* and 26*b*.

FIG. 1*b* is a schematic partial view of a door arrangement in which the actuating element 28 is brought into the actuation position for "opening the left attachment side", such as into position 2 (POS2). In the actuation position for "opening the left attachment side" (POS2), the left pivot pins 18*a* and 24*a* are disengaged from the left pivot pin receptacles 20*a* and 26*a* and the door panel 14 can pivot around the right hinge 16*b*.

FIG. 1*c* is a schematic partial view of a door arrangement in which the actuating element 28 is brought into the actuation position for "opening the right attachment side", such as into position 3 (POS3). In the actuation position for "opening the right attachment side" (POS3), the right pivot pins 18*b* and 24*b* are disengaged from the right pivot pin receptacles 20*b* and 26*b* and the door panel 14 can pivot around the left hinge 16*a*.

As shown in FIGS. 1*a* through 1*c*, the left and right hinges 16*a* and 16*b* combine with the actuating element 28 to form a closing mechanism, which produces a hinge or a latch on one or both attachment sides 12*a* and 12*b* of the door panel 14, depending on the actuation position POS1, POS2, or POS3 of the actuating element 28.

The latch can be situated on a door, a wall, or a cover equipped with a mechanism that has at least the three actuating positions POS1, POS2, or POS 3.

Figure 2:
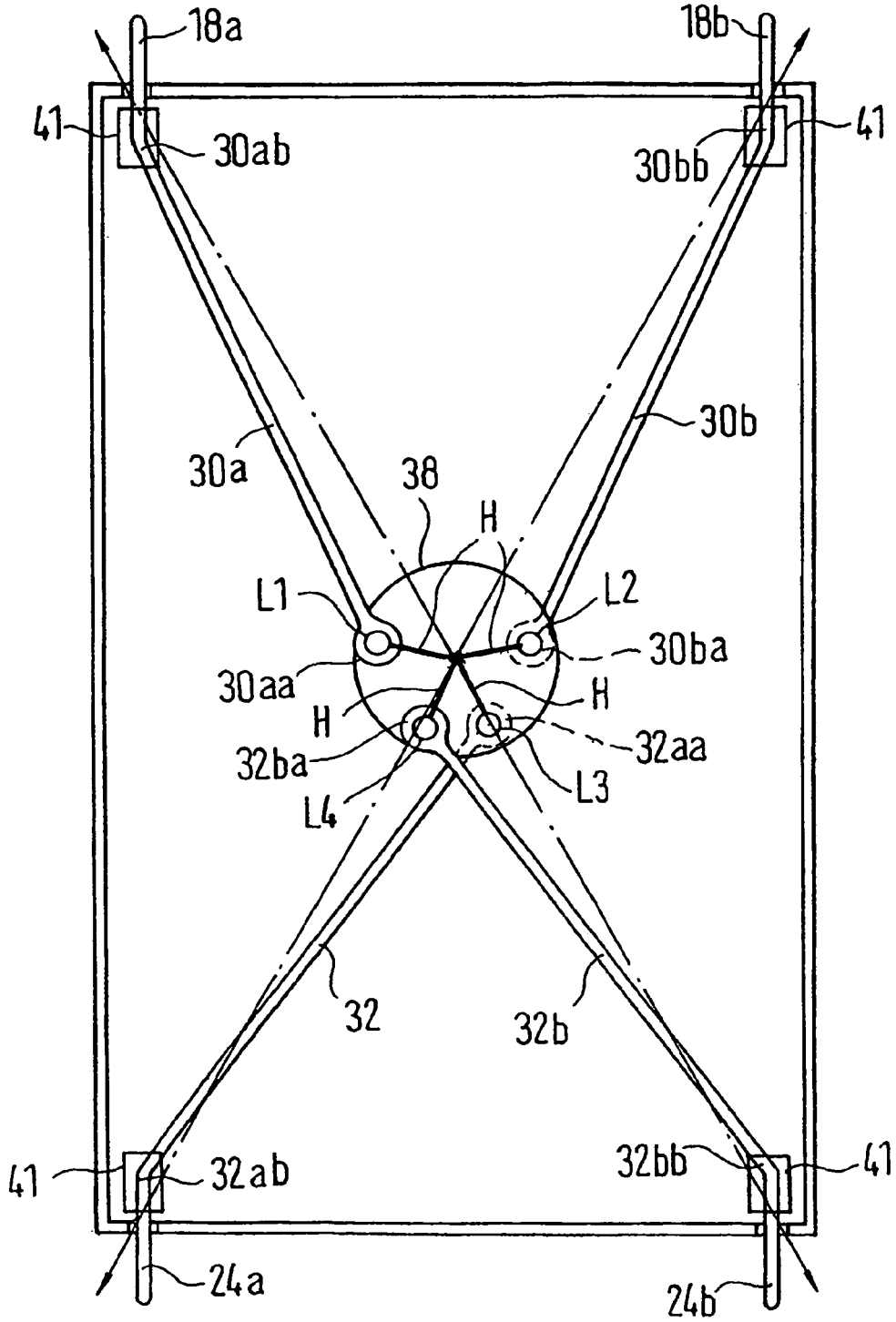
FIG. 2 is a transparent, schematic front view of the side of the door panel oriented toward the user, with an arrangement of four actuating rods.

FIG. 2 is a schematic front view of the side of the door panel 14 oriented toward the user, with an arrangement of four actuating rods 30*a*, 30*b*, 32*a*, and 32*b*, that are attached at one end 30*ab*, 30*bb*, 32*ab*, 32*bb* to the end region of the pivot pins 18*a*, 18*b*, 24*a*, 24*b* oriented away from the associated pivot pin receptacles 20*a*, 20*b*, 26*a*, 26*b*.

With their other ends 30*aa*, 30*ba*, 32*aa*, 32*ba*, the actuating rods 30*a*, 30*b*, 32*a*, and 32*b* are pivotably supported on the lever arm H. The actuating rods 30*a*, 30*b*, 32*a*, 32*b* are of metal that is integrally joined to the pivot pins 18*a*, 18*b*, 24*a*, 24*b*.

In an alternative embodiment, not shown, the pivot pins 18*a*, 18*b*, 24*a*, 24*b* can also be actuated by a system of cables.

The actuating element 28 has a disk 38 that can be rotated around the axle A. The ends 30*aa*, 30*ba*, 32*aa*, 32*ba* of the actuating rods 30*a*, 30*b*, 32*a*, 32*b* oriented away from the pivot pins 18*a*, 18*b*, 24*a*, 24*b* engage the disk 38 at respective bearing points L1, L2, L3, L4 spaced apart from the axle A by a distance that corresponds to the lever arm H. The rotatable disk 38 is positioned on the side of the door panel 14 oriented away from the user and parallel to the door panel 14. The axle A connected to the rotatable disk 38 extends through the door panel 14 toward the user. At the end oriented toward the user, the actuating element 28 has an actuating handle 40, as shown, for example, in FIGS. 1*a* through 1*c*.

Depending on the rotation direction of the actuating element 28 and the disk 38, two of the four actuating rods 30*a*, 30*b*, 32*a*, and 32*b* arranged on the door are always actuated so that one side opens and the other side remains closed. With this design, a door can thus be selectively opened at either the right or left side.

In the "closed" actuation position (POS1), the left pivot pins 18*a* and 24*a* are fully engaged with the two left pivot pin receptacles 20*a* and 26*a* while the right pivot pins 18*b* and 24*b* are fully engaged with the two right pivot pin receptacles 20*b* and 26*b*.

In the actuation position for "opening the left attachment side" (POS2), the left pivot pins 18*a* and 24*a* are fully disengaged from the left pivot pin receptacles 20*a* and 26*a*.

In the actuation position for "opening the right attachment side" (POS3), the right pivot pins 18*b* and 24*b* are fully disengaged from the right pivot pin receptacles 20*b* and 26*b*.

As shown in FIG. 2, the bearing points L1, L2, L3, and L4 for the actuator or the actuating means 30*a*, 30*b*, 32*a*, and 32*b* are situated on both sides of the rotatable disk 38. The bearing point L1 for the actuating means 30*a* connected to the upper left pivot pin 18*a* and the bearing point L4 for the actuating means 32*b* connected to the lower right pivot pin 24*b* are positioned on one side of the rotatable disk 38. The bearing point L2 for the actuating means 30*b* connected to the upper right pivot pin 18*b* and the bearing point L3 for the actuating means 32*a* connected to the lower left pivot pin 24*a* are positioned on the other side of the rotatable disk 38.

The pivot pins 18*a*, 18*b*, 24*a*, 24*b* each has a respective locking device that can be embodied in different embodiment forms and will be described in greater detail in conjunction with FIGS. 3 through 13. The function of the locking device 41 that acts on the upper left pivot pin 18*a* will be explained below. The locking devices 41 mounted on the remaining pivot pins 18*b*, 24*a*, and 24*b* are all embodied in the same way as it.

Figure 3:
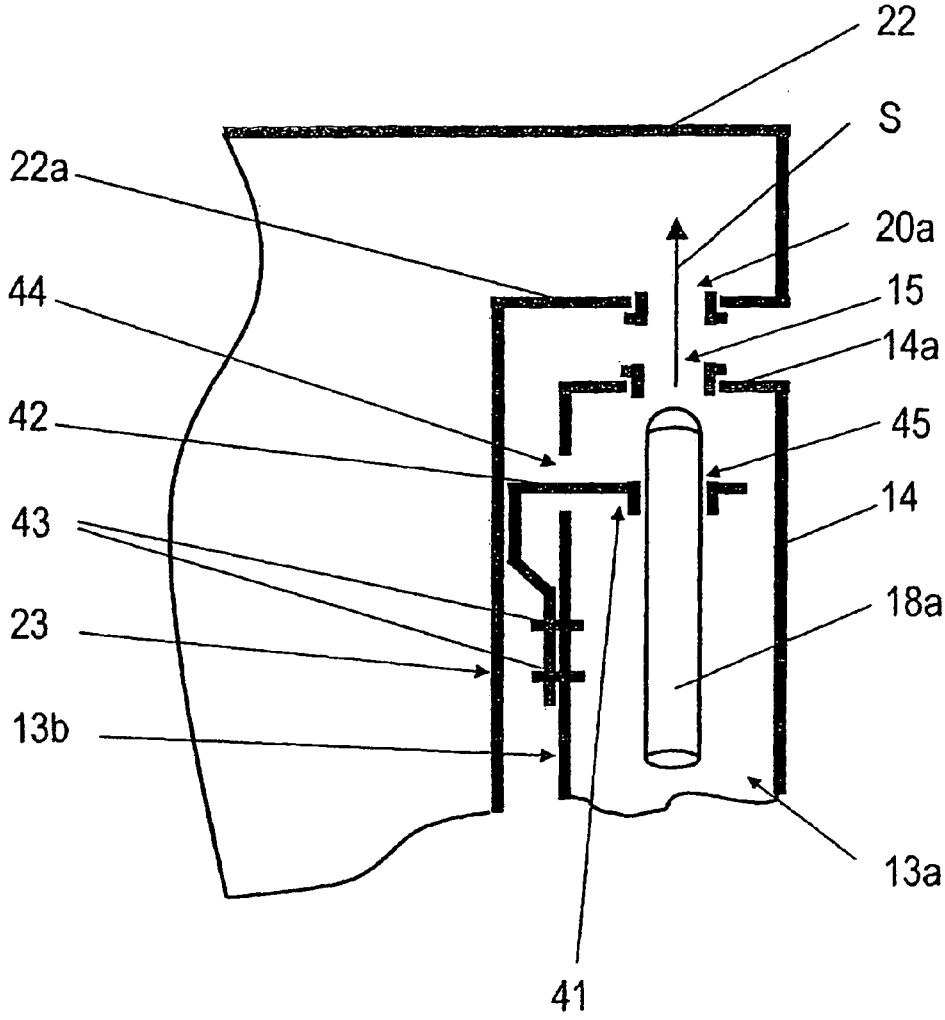
FIG. 3 is a schematic, sectional side view of a closed door with a hinge arrangement in which the upper left pivot pin can be brought upward into engagement with the upper left pivot pin receptacle in the housing by being slid vertically, and a locking device, which has a securing spring composed of a piece of sheet metal mounted to the outside of the door, is in the unlocked position in which it acts laterally on the pivot pin.

FIG. 3 is a schematic side view of a closed door 14 with a hinge arrangement. The door is embodied as a metal door with a door interior 13*a* that is bordered by the door panel.

The upper left pivot pin 18*a* shown in FIGS. 1*a* through 1*c* and 2 can be brought from a retracted position, as shown in FIG. 3, in which the pivot pin 18*a* is not engaged with the pivot pin receptacle 20*a*, into an extended position, not shown, by being vertically slid in the direction of the arrow S. The pivot pin 18*a* can be slid through a pivot pin passage 15 on the door edge 14*a* facing the housing part 22*a* that extends perpendicular to the pivot pin 18*a*, moving in the direction of the pivot pin receptacle 20*a* aligned with the pivot pin passage 15. In the extended position, the pivot pin 18*a* is then engaged with the pivot pin receptacle 20*a* and rotatably supported therein. The sliding occurs by the actuating rod 30*a*, not shown, upon actuation of the actuating element 28 and rotatable disk 38 shown in FIGS. 1*a* through 1*c* and 2.

An unlockable spring-loaded locking device 41 acts on the pivot pin 18*a*. The locking device 41 has a securing spring 42 formed as a metal spring element composed of a piece of sheet metal. One end of the securing spring 42 is mounted to the outer surface 13*b* of the door 14 oriented toward the housing wall 23 by a screw connection 43 or by rivets. On the side oriented toward the housing wall 23, the door 14 has an opening 44 leading to the door interior 13*a*.

The securing spring 42 extends from the screw connection 43 toward the housing wall 23, then extends along the housing wall 23, and finally extends at a right angle into the door interior 13*a*. In the arrangement shown in FIG. 3, when the door 14 is closed, the housing wall 23 pushes the securing spring 42 toward the door interior 13*a* and holds it there under tension. In FIG. 3, the locking device is in its unlocked position.

The part of the securing spring 42 extending in the door interior 13*a* has a through bore 45 extending perpendicular to the pivot pin 18*a*, through which the pivot pin 18*a* extends. In the unlocked position of the locking device 41 shown in FIG. 3, the through bore 45 is aligned with the pivot pin passage 15 and the pivot pin receptacle 20*a*.

Figure 4:
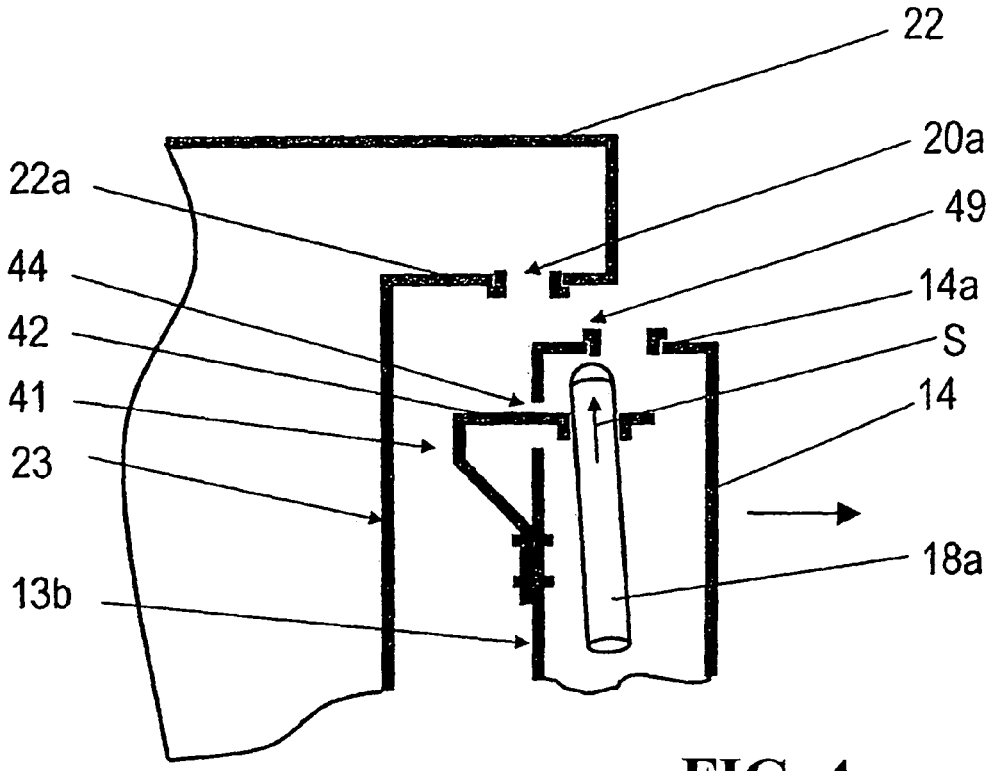
FIG. 4 is a schematic, sectional side view of the arrangement according to FIG. 3, in which the door is open and the locking device is locked.

FIG. 4 is a schematic, sectional side view of the arrangement according to FIG. 3, in which the door 14 is open and the locking device 41 is locked. The securing spring 42 exerts its action between the door 14 and the pivot pin 18*a* and acts laterally on the pivot pin 18*a* in the locked position of the locking device 41.

In the arrangement shown in FIG. 4, when the door is open, the housing wall 23 is no longer pushing the securing spring 42 in the direction of the door interior 13*a* and holding it there under tension. The securing spring 42 can therefore relax. In so doing, the securing spring 42 slides the pivot pin 18*a* laterally into the locked position of the locking device 41 so that the sliding direction S of the pivot pin 18*a* points toward a region 49 of the door 14 adjacent to the pivot pin passage 15. In the sliding direction S, the pivot pin 18*a* strikes against this region 49 and cannot be guided through the pivot pin passage 15. The pivot pin 18*a* is locked in its retracted position.

At the same time, the lower left pivot pin 24*a* shown in FIGS. 1*a* through 1*c* and 2 is also locked in its retracted position in the same way. In this case, the hinge 16*a* embodied on the left attachment side 12*a* functions as an open latch. Because in this position, the actuating lever 40 is positioned in the actuation position for "opening the right attachment side" (POS3), the hinge 16*b* on the right attachment side 12*b* is engaged.

Because the pivot pins 18*a* and 24*a* cannot be brought into the extended position due to the locked locking device 41, the actuating rods 30*a* and 32*a* shown in FIG. 2 likewise can no longer be slid. This in turn affects the rotatable disk 38 so that the actuating rods 30*b* and 32*b* for the right hinge 16*b* also cannot be moved. The locking device 41 thus reliably prevents the open door from being inadvertently unhinged through actuation of the actuating lever 40.

Figure 5:
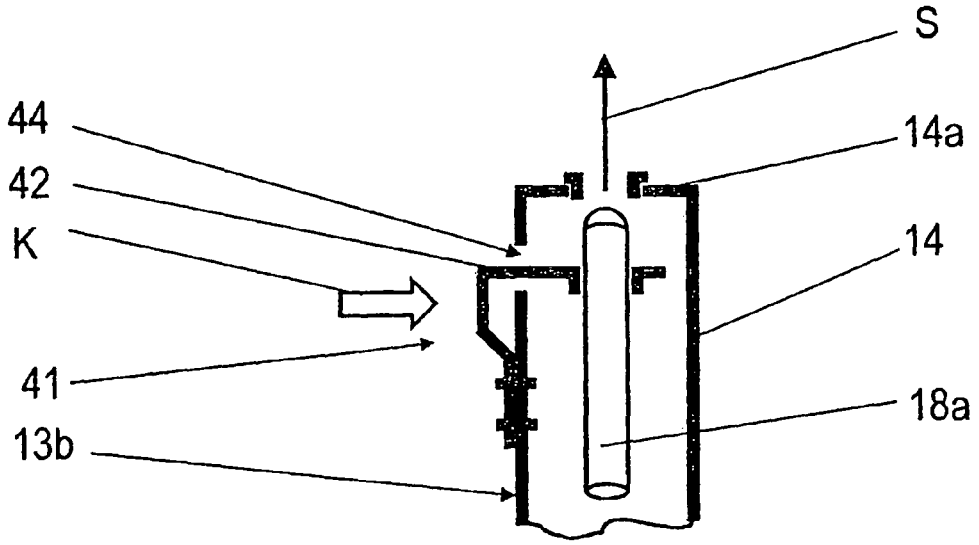
FIG. 5 is a schematic, sectional side view of the hinge arrangement according to FIGS. 3 and 4 in which the door is open and the securing spring is manually actuated in order to unlock the locking device.

FIG. 5 is a schematic, sectional side view of the hinge arrangement according to FIGS. 3 and 4, in which the door is open. Through direct manual force exertion, the securing spring 42 can be actuated in direction K in opposition to its prestressing direction, thus bringing the locking device 41 back into its unlocked position.

Figure 6:
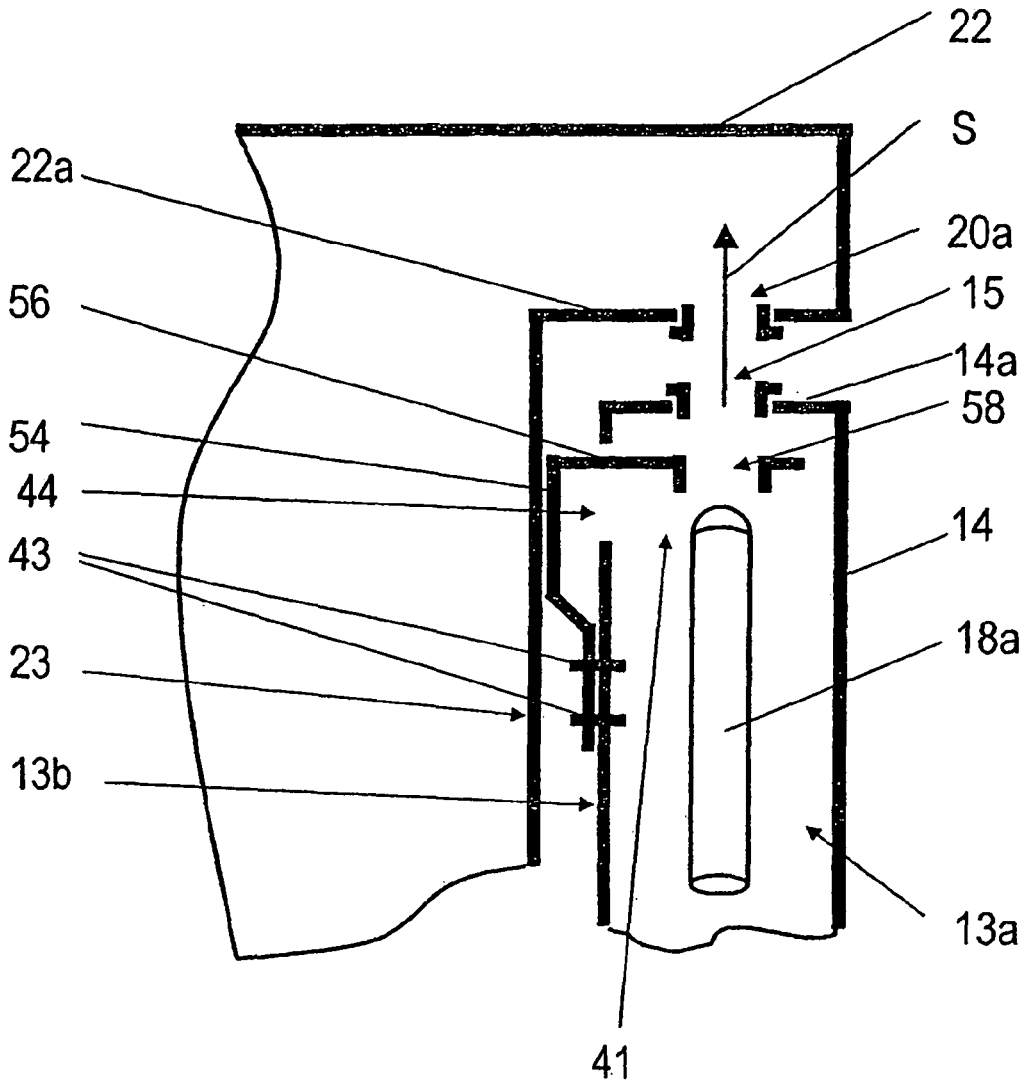
FIG. 6 is a schematic, sectional side view of a closed door with a hinge arrangement in which the upper left pivot pin can be brought upward into engagement with the upper left pivot pin receptacle in the housing by being slid vertically, and a locking device, which has a securing spring composed of a piece of sheet metal mounted to the outside of the door, is in the unlocked position in which it uncovers the pivot pin passage at the top of the door.

FIG. 6 is a schematic, sectional side view of a closed door 14 with a different embodiment of a hinge arrangement. A securing spring 54 acts on the door 14 and has a guide plate 56 positioned perpendicular to the pivot pin 18*a*, between it and the pivot pin passage 15.

The securing spring 54 is formed as a metal spring element composed of a piece of sheet metal. One end of the securing spring 54 is mounted to the outer surface 13*b* of the door 14 oriented toward the housing wall 23 by a screw connection 43 or by rivets. On the side oriented toward the housing wall 23, the door 14 has an opening 44 leading to the door interior 13*a*.

The securing spring 54 extends from the screw connection 43 toward the housing wall 23, then extends along the housing wall 23, and finally extends at a right angle through the opening 44 into the door interior 13*a*.

In the arrangement shown in FIG. 6, when the door 14 is closed, the housing wall 23 pushes the securing spring 54 toward the door interior 13*a* and holds it there under tension. In FIG. 6, the locking device is in its unlocked position.

The part of the securing spring 54 extending into the door interior 13*a* is embodied in the form of a guide plate 56 and has a through bore 58 extending perpendicular to the pivot pin 18*a*. In the unlocked position of the locking device 41 shown in FIG. 6, the through bore 58 is aligned with the pivot pin passage 15 and pivot pin receptacle 20*a* so that the pivot pin 18*a* can be slid through the through bore 58, the pivot pin passage 15, and the pivot pin receptacle 20*a*.

Figure 7:
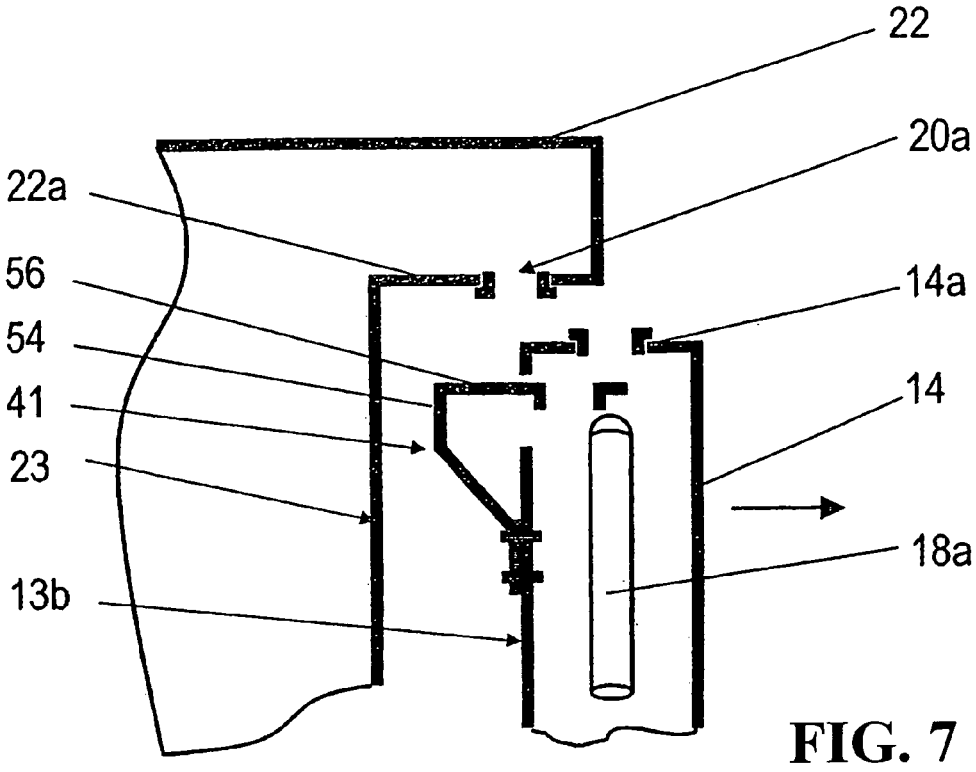
FIG. 7 is a schematic, sectional side view of the arrangement according to FIG. 6, and the door is open and the locking device is in the locked position in which the sheet metal element covers the pivot pin passage at the top of the door.

FIG. 7 is a schematic, sectional side view of the arrangement according to FIG. 6, and the door 14 is open and the locking device 41 is in the locked position in which the guide plate 56 covers the pivot pin passage 15 at the top 14*a* of the door 14.

In the arrangement shown in FIG. 7, when the door 14 is open, the housing wall 23 is no longer pushing the securing spring 54 in the direction of the door interior 13*a* and holding it there under tension. The securing spring 54 can therefore relax. In so doing, the securing spring 54 slides the cover plate 56 into the locked position of the locking device 41 so that the sliding direction S of the pivot pin 18*a* no longer points through the through bore 58, but at the underside of the cover plate 56. In the sliding direction S, the pivot pin 18*a* strikes against the underside of the cover plate and cannot be guided through the through bore 58. The pivot pin 18*a* is locked in its retracted position.

Figure 8:
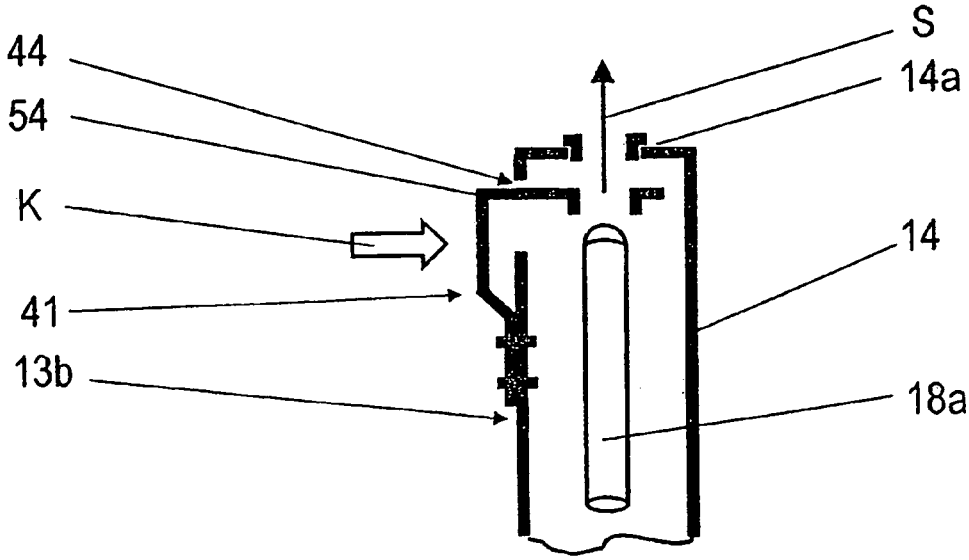
FIG. 8 is a schematic, sectional side view of the hinge arrangement according to FIGS. 6 and 7 in which the door is open and the securing spring is manually actuated in order to unlock the locking device by causing the sheet metal element to uncover the pivot pin passage at the top of the door.

FIG. 8 is a schematic, sectional side view of the hinge arrangement according to FIGS. 6 and 7. Through a direct manual exertion of force in direction K, the securing spring 42 can be actuated in opposition to its prestressing direction, thus bringing the locking device 41 back into its unlocked position.

Figure 9:
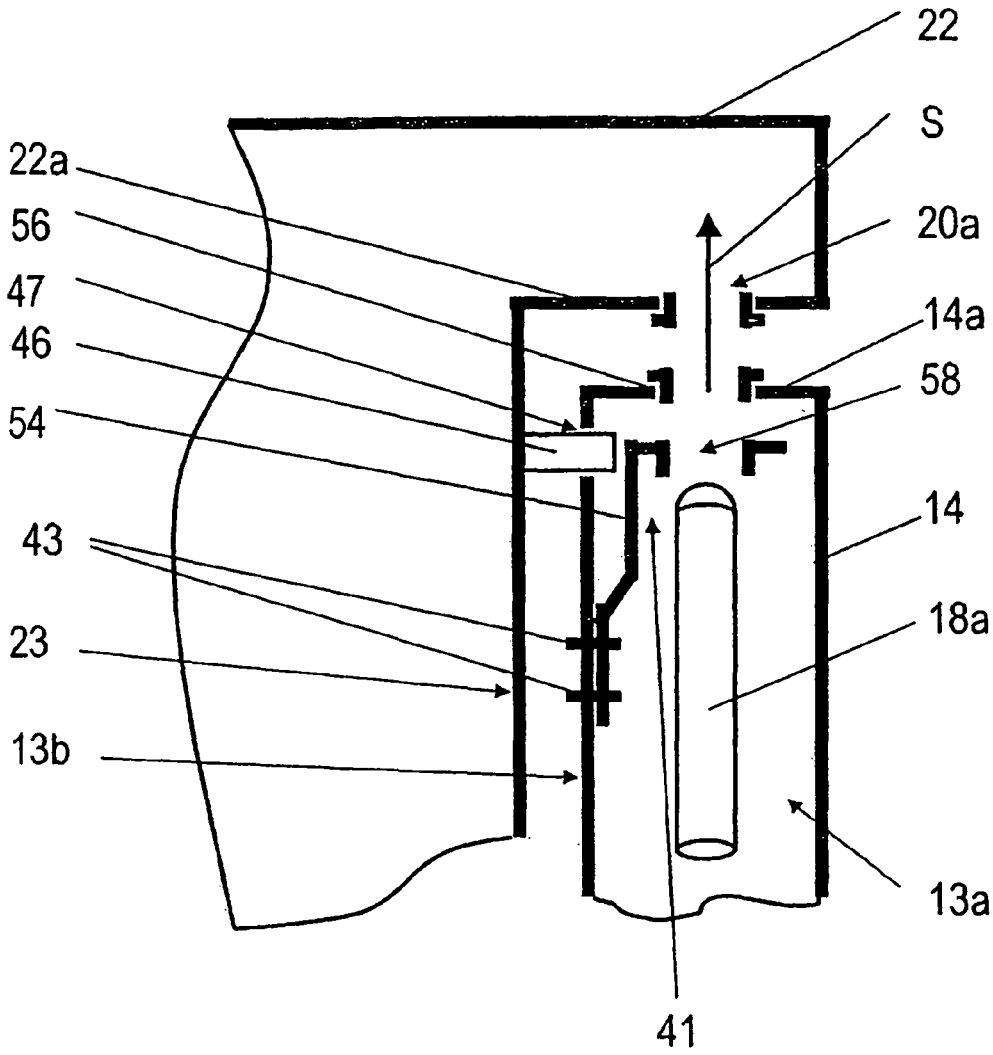
FIG. 9 is a schematic, sectional side view of a closed door with a hinge arrangement in which the upper left pivot pin can be brought upward into engagement with the upper left pivot pin receptacle in the housing by being slid vertically, and a locking device, which has a securing spring composed of a piece of sheet metal mounted to the inside of the door in a covered position, is in the unlocked position in which it uncovers the pivot pin passage at the top of the door.

FIG. 9 is a schematic, sectional side view of a closed door 14 with a different embodiment of a hinge arrangement. The pivot pin 18*a* can be brought from a retracted position, as shown in FIG. 9, in which the pivot pin 18*a* is not engaged with the pivot pin receptacle 20*a*, into an extended position by being vertically slid in the direction of the arrow S. The pivot pin 18*a* can be slid through a pivot pin passage 15 on the door edge 14*a* facing the housing part 22*a* that extends perpendicular to the pivot pin 18*a*, moving in the direction of the pivot pin receptacle 20*a* aligned with the pivot pin passage 15. In the extended position, the pivot pin 18*a* is then engaged with the pivot pin receptacle 20*a* and rotatably supported therein.

An unlockable spring-loaded locking device 41 acts on the pivot pin 18*a*. The locking device 41 has a securing spring 54 that is embodied in the form of a metal spring element of a piece of sheet metal. The securing spring 54 is mounted to the door interior 13*a* on the side oriented toward the housing wall 23 by a screw connection 43.

The securing spring 54 extends from the screw connection 43 toward the door interior 13*a*, then extends parallel to the pivot pin 18*a*, and finally, in the form of a cover plate 56, extends at a right angle to the pivot pin 18*a*. The cover plate 56 has a through bore 58 extending perpendicular to the pivot pin 18*a*.

In the unlocked position of the locking device 41 shown in FIG. 9, the through bore 58 is aligned with the pivot pin passage 15 and the pivot pin receptacle 20*a* so that through actuation of the actuating lever 40, the pivot pin 18*a* can be slid through the through bore 58, the pivot pin passage 15, and the pivot pin receptacle 20*a*.

On the housing wall 23, a pin 46 is provided, which, when the door 14 is closed, extends through an associated opening 47 into the door interior 13*a* and acts on the securing spring 54, thus bringing the locking device 41 into its unlocked position.

Figure 10:
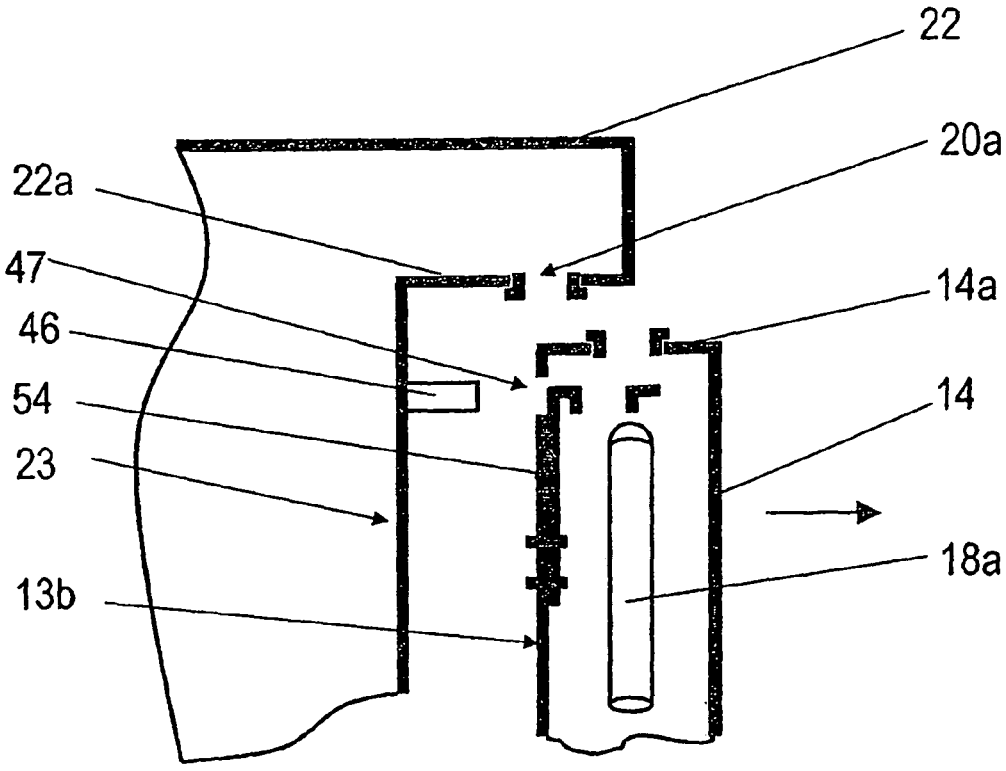
FIG. 10 is a schematic, sectional side view of the arrangement according to FIG. 9, and the door is open and the locking device is in the locked position in which the sheet metal element covers the pivot pin passage at the top of the door.

FIG. 10 is a schematic, sectional side view of the arrangement according to FIG. 9. The door 14 is open and the locking device 41 is in the locked position in which the guide plate 56 covers the pivot pin passage 15 at the top 14*a* of the door 14.

In the arrangement shown in FIG. 10, when the door 14 is open, the pin 46 positioned on the housing wall 23 is no longer pushing the securing spring 54 in the direction of the door interior 13*a* and holding it there under tension. The securing spring 54 can thus relax. In so doing, the securing spring 54 slides the cover plate 56 into the locked position of the locking device 41 so that the sliding direction S of the pivot pin 18*a* no longer points through the through bore 58, but at the underside of the cover plate 56. In the sliding direction S, the pivot pin 18*a* strikes against the underside of the cover plate and cannot be guided through the through bore 58. The pivot pin 18*a* is locked in its retracted position.

Figure 11:
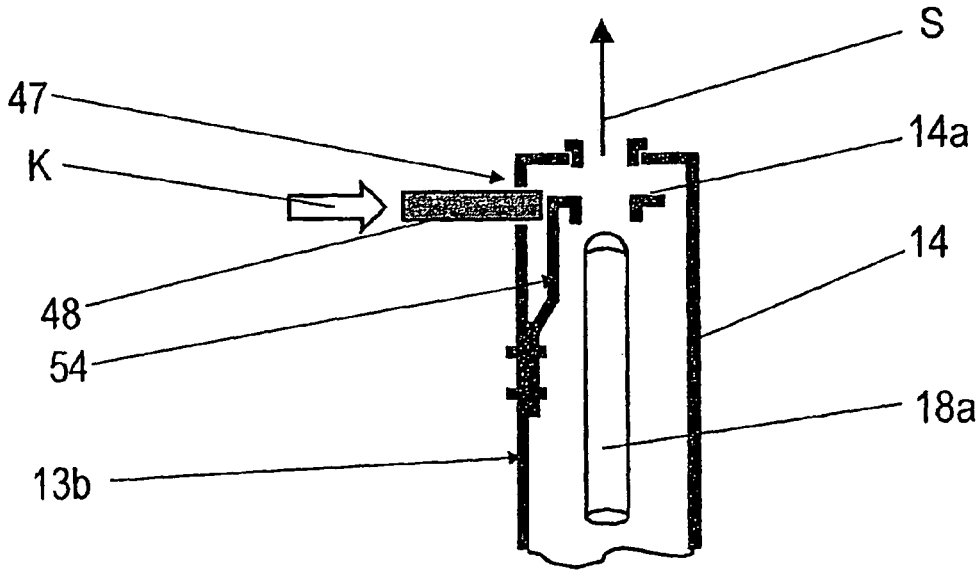
FIG. 11 is a schematic, sectional side view of the hinge arrangement according to FIGS. 9 and 10, in which the door is open and the securing spring is manually actuated by an actuating pin in order to unlock the locking device by causing the sheet metal element to uncover the pivot pin passage at the top of the door.

FIG. 11 is a schematic, sectional side view of the hinge arrangement according to FIGS. 9 and 10. The securing spring 42 can be manually actuated, through insertion of an actuating pin 48 into the opening 47, in direction K in opposition to its prestressing direction, thus bringing the locking device 41 back into its unlocked position.

Figure 12:
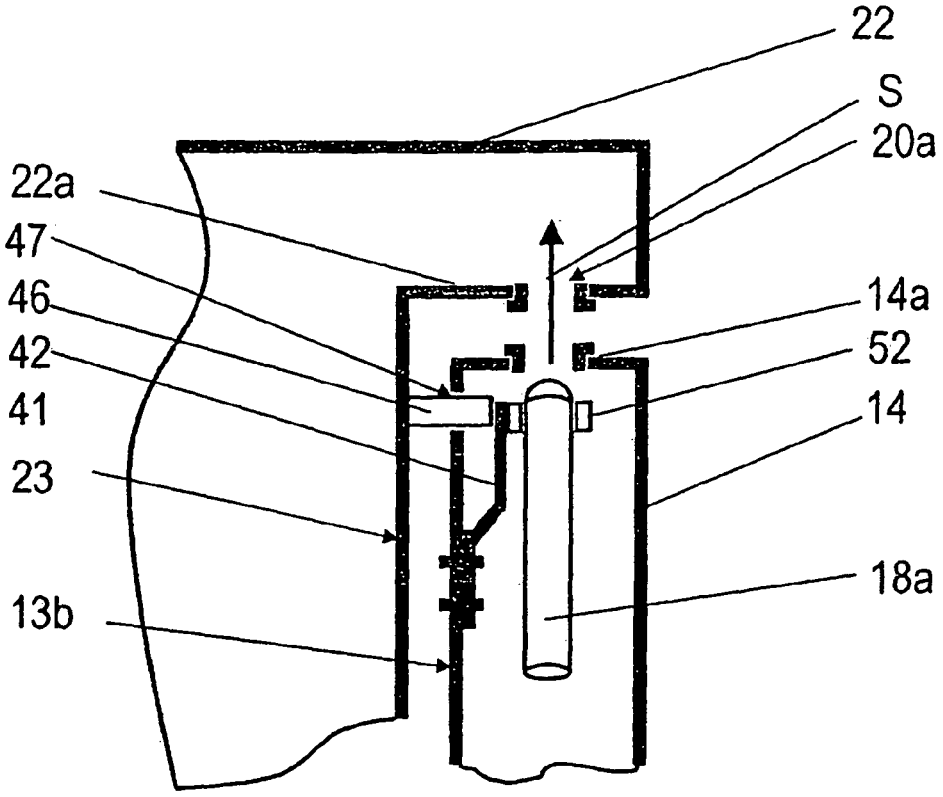
FIG. 12 is a schematic, sectional side view of a closed door with a hinge arrangement in which the upper left pivot pin can be brought upward into engagement with the upper left pivot pin receptacle in the housing by being slid vertically, and a locking device, which has a securing spring of a piece of sheet metal that is mounted on the inside of the door, is in the unlocked position in which it acts laterally on a pin guide in which the pivot pin is guided.

FIG. 12 is a schematic, sectional side view of a closed door with yet another embodiment form of a hinge arrangement. An unlockable spring-loaded locking device 41 acts on the pivot pin 18*a*. The locking device 41 has a securing spring 42 that is embodied in the form of a metal spring element composed of a piece of sheet metal. The securing spring 42 is mounted to the door interior 13*a*, on the side oriented toward the housing wall 23, by a screw connection 43.

The securing spring 42 extends from the screw connection 43 toward the door interior 13*a*, then extends parallel to the pivot pin 18*a*. At the free end of the securing spring 42, an annular pin guide 52 is provided, in which the pivot pin 18*a* is supported.

In the unlocked position of the locking device 41 shown in FIG. 12, the pin guide 52 is aligned with the pivot pin passage 15 and the pivot pin receptacle 20*a* so that through actuation of the actuating lever 40, the pivot pin 18*a* can be slid through the pivot pin passage 15, and the pivot pin receptacle 20*a*.

On the housing wall 23, a pin 46 is provided, which, when the door 14 is closed, extends through an associated opening 47 into the door interior 13*a* and acts on the securing spring 42, thus bringing the locking device 41 into its unlocked position.

Figure 13:
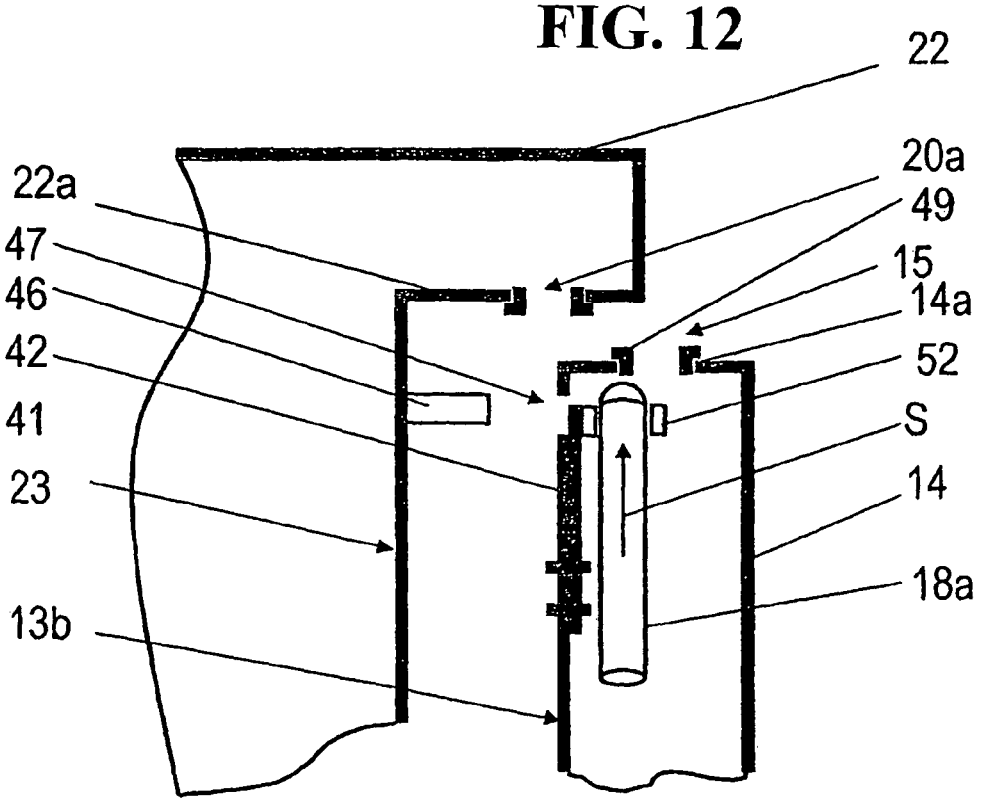
FIG. 13 is a schematic, sectional side view of the arrangement according to FIG. 12, in which the door is open and the locking device is locked.

FIG. 13 is a schematic, sectional side view of the arrangement according to FIG. 12, in which the door 14 is open and the locking device 41 is in the locked position. The securing spring 42 exerts its action between the door 14 and the pivot pin 18*a* and, via the pin guide 52, acts laterally on the pivot pin 18*a* in the locked position of the locking device 41.

In the arrangement shown in FIG. 13, when the door is open, the pin 46 positioned on the housing wall 23 is no longer pushing the securing spring 42 in the direction of the door interior 13*a* and holding it there under tension. The securing spring 42 can thus relax. In so doing, the securing spring 42 slides the pivot pin 18*a* laterally into the locked position of the locking device 41 so that the sliding direction S of the pivot pin 18*a* points at a region 49 of the door 14 adjacent to the pivot pin passage 15. In the sliding direction S, the pivot pin 18*a* strikes against the region 49 and cannot be guided through the pivot pin passage 15. The pivot pin 18*a* is locked in its retracted position.

The invention claimed is:

1. A hinge arrangement of a door (14) for a housing (22) for closing an opening comprising a housing opening, a partition opening, a wall opening, or a similar opening, the hinge arrangement comprising:

at least one pivot pin (18*a*, 18*b*, 24*a*, 24*b*) connected to the door (14), pointing vertically toward the housing (22), and that can be brought into engagement in a pivot pin receptacle (20*a*, 20*b*, 26*a*, 26*b*) in the housing (22);

an actuating element in combination with the pivot pin (18*a*), wherein the actuating element vertically moves the pivot pin (18*a*) from a retracted position in which the pivot pin (18*a*) is not engaged in the pivot pin receptacle (20*a*) into an extended position in which the pivot pin (18*a*) is engaged with and rotatably supported in the pivot pin receptacle (20*a*);

an unlockable spring-loaded locking device (41) acting on the pivot pin (18*a*) and holding the pivot pin (18*a*) in the retracted position, wherein releasing the locking device aligns the pivot pin (18*a*) with a pivot pin passage (15) positioned on a door edge (14*a*) oriented toward the housing (22), moving in a direction toward the pivot pin receptacle (20*a*) aligned with the pivot pin passage (15), the locking device (41) comprising a securing spring (42) mounted to an outside (13*b*) of the door (14), including a first portion oriented toward a housing wall (23), and including a second portion protruding through an associated opening (44) into the door interior (13*a*) and in combination with the pivot pin (18*a*) to exert an action on the pivot pin (18*a*) inside the door, wherein the securing spring (42) exerts action between the door (14) and the pivot pin (18*a*), acting laterally on the pivot pin (18*a*) and sliding the pivot pin (18*a*) laterally between an unlocked position and a locked position of the locking device (41), wherein in the locked position a vertical sliding direction (S) of the pivot pin (18*a*) points toward a region of the door (14) adjacent to the pivot pin passage (15) and the pivot pin (18*a*) cannot be guided through the pivot pin passage (15).

2. The hinge arrangement as recited in claim 1, wherein movement of the securing spring (42) in opposition to a prestressed direction that is toward the housing wall (23) brings the locking device (41) into the unlocked position.

3. The hinge arrangement as recited in claim 2, wherein the securing spring (42) is a metal spring element of a piece of sheet metal.

4. The hinge arrangement as recited in claim 3, wherein the securing spring (42) comprises a through bore positioned within the door interior (13*a*), through which the pivot pin (18*a*) extends.

5. The hinge arrangement as recited in claim 4, wherein when the door (14) is closed, the securing spring (42) contacting the housing wall (23) actuates the securing spring (42) into the unlocked position.

6. The hinge arrangement as recited in claim 4, wherein the securing spring (42) comprises a pin guide (52) supporting the pivot pin (18*a*) within the through bore.

7. The hinge arrangement as recited in claim 1, wherein the securing spring (42) is a metal spring element of a piece of sheet metal.

8. The hinge arrangement as recited in claim 1, has comprises a through bore positioned within the door interior (13*a*), through which the pivot pin (18*a*) extends.

9. The hinge arrangement as recited in claim 1, wherein when the door (14) is closed, the securing spring (42) contacting the housing wall (23) actuates the securing spring (42) into the unlocked position.

10. The hinge arrangement as recited in claim 1, wherein the securing spring (42) comprises a pin guide (52) supporting the pivot pin (18*a*) within the through bore.

11. A hinge arrangement of a door (14) for a housing (22) for closing an opening comprising a housing opening, a partition opening, a wall opening, or a similar opening, the hinge arrangement comprising:

at least one pivot pin (18*a*, 18*b*, 24*a*, 24*b*) connected to the door (14), pointing vertically toward the housing (22), and that can be brought into engagement in a pivot pin receptacle (20*a*, 20*b*, 26*a*, 26*b*) in the housing (22);

an actuating element in combination with the pivot pin (18*a*), wherein the actuating element vertically moves the pivot pin (18*a*) from a retracted position in which the pivot pin (18*a*) is not engaged in the pivot pin receptacle (20*a*) into an extended position in which the pivot pin (18*a*) is engaged with and supported in the pivot pin receptacle (20*a*);

an unlockable spring-loaded locking device (41) holding the pivot pin (18*a*) in the retracted position, wherein releasing the locking device aligns the pivot pin (18*a*) with a pivot pin passage (15) positioned on a door edge (14*a*) oriented toward the housing (22), the locking device (41) comprising a securing spring (54) mounted to the door (14), wherein the securing spring (54) acts on the door (14) and covers the pivot pin passage (15) in the locked position of the locking device (41) so that the pivot pin (18*b*) cannot be inserted through the pivot pin passage (15).

12. The hinge arrangement as recited in claim 11, wherein the securing spring (54) has a through bore (58) aligned with the pivot pin passage (15) when the locking device (41) is unlocked.

* * * * *